US007699559B2

(12) United States Patent
Linde

(10) Patent No.: US 7,699,559 B2
(45) Date of Patent: Apr. 20, 2010

(54) DEVICE AND METHOD FOR MODIFYING THE LAYOUT OF A VEHICLE RACING COURSE

(76) Inventor: Albrecht von Linde, Nordliche Seestrasse 41, Ammerland (DE) D-82541

( * ) Notice: Subject to any disclaimer, the term of this patent is extended or adjusted under 35 U.S.C. 154(b) by 695 days.

(21) Appl. No.: 10/537,041

(22) PCT Filed: Nov. 26, 2003

(86) PCT No.: PCT/EP03/13324

§ 371 (c)(1),
(2), (4) Date: Nov. 29, 2005

(87) PCT Pub. No.: WO2004/050999

PCT Pub. Date: Jun. 17, 2004

(65) Prior Publication Data

US 2006/0127174 A1 Jun. 15, 2006

(30) Foreign Application Priority Data

Dec. 2, 2002 (DE) ..... 102 56 199

(51) Int. Cl.
*E01F 15/00* (2006.01)
*E01F 15/12* (2006.01)

(52) U.S. Cl. ..... 404/11; 404/6; 404/9; 404/10

(58) Field of Classification Search ..... 404/6, 404/7, 9–11; 256/13.1
See application file for complete search history.

(56) References Cited

U.S. PATENT DOCUMENTS 1,949,295 A * 2/1934 Dean ..... 404/11
2,143,433 A 1/1939 Curtis
2,519,145 A * 8/1950 Manly ..... 404/11
3,841,775 A * 10/1974 Pare ..... 404/11
3,963,363 A 6/1976 Roper
4,490,068 A * 12/1984 Dickinson ..... 404/6
4,629,357 A * 12/1986 Wattenburg et al. ..... 404/6
4,632,598 A * 12/1986 Richards ..... 404/6
4,690,583 A * 9/1987 Faulconer ..... 404/6
4,737,049 A * 4/1988 Callhan ..... 359/551
4,775,261 A * 10/1988 Fladung ..... 404/6

(Continued)

FOREIGN PATENT DOCUMENTS

DE 4422050 1/1996

(Continued)

OTHER PUBLICATIONS

Prospectus: Ein Verkehrsplatz aus dem Baukasten, Fa. Luft, Jan. 2001, pp. 1-4.

(Continued)

*Primary Examiner*—Raymond W Addie
(74) *Attorney, Agent, or Firm*—Jenkins, Wilson, Taylor & Hunt, P.A.

(57) ABSTRACT

A device for modifying the layout of a vehicle racing course in a wide track section thereof including an arrangement consisting of individual elements for defining the edge of the track located in the region of the track section, which can be displaced, either individually or in groups, from an initial configuration of the track section into a new configuration for reshaping a bend in the racing course or/and for dividing the racing course.

12 Claims, 7 Drawing Sheets

U.S. PATENT DOCUMENTS

| | | | | |
|---|---|---|---|---|
| 5,009,542 | A * | 4/1991 | Hardin et al. | 404/6 |
| 5,498,100 | A * | 3/1996 | Guernsey | 404/6 |
| 5,509,753 | A * | 4/1996 | Thompson | 404/6 |
| 6,010,277 | A * | 1/2000 | Follman | 404/11 |
| 6,059,487 | A | 5/2000 | Haga et al. | |
| 6,439,801 | B1 * | 8/2002 | Galiana et al. | 404/6 |
| 6,439,802 | B1 * | 8/2002 | Duckett | 404/6 |
| 6,457,900 | B2 * | 10/2002 | Bond | 404/15 |
| 6,926,462 | B1 * | 8/2005 | Fuganti et al. | 404/6 |
| 2001/0048845 | A1 | 12/2001 | Jack | |
| 2002/0090259 | A1 | 7/2002 | Crowley et al. | |

FOREIGN PATENT DOCUMENTS

| | | |
|---|---|---|
| DE | 19536107 | 4/1997 |
| DE | 19619787 | 11/1997 |
| DE | 19632026 | 11/1997 |
| DE | 19621884 | 12/1997 |
| DE | 19737711 | 3/1999 |
| DE | 1074662 | 2/2001 |
| DE | 19941056 | 4/2001 |
| GB | 908805 | 10/1962 |
| WO | WO 93/15274 | 8/1993 |
| WO | WO03/012207 | 2/2003 |

OTHER PUBLICATIONS

PCT International Search Report dated Apr. 22, 2004.
German Office Action dated Jul. 21, 2003.
PCT International Preliminary Examination Report dated Mar. 30, 2005.

* cited by examiner

DEVICE AND METHOD FOR MODIFYING THE LAYOUT OF A VEHICLE RACING COURSE

TECHNICAL FIELD

The invention relates to a device and a method for modifying the layout of a vehicle racing course in a wide track section thereof.

BACKGROUND ART

Vehicle races, especially Formula-1 races, take place on traditional racing courses the construction of which is based on individual designs and which make high demands on the skills of the drivers and the quality of the vehicle. Lately, it has been noticed that races of formula vehicles, racing cars, touring cars, trucks, motorcycles, karts etc. become less and less exciting due to the technical development. A principal reason for this is that the overtaking manoeuvres, which actually are the thrilling thing about races, have become nearly impossible. This is, inter alia, due to the fact that the development in the aerodynamic field requires a larger distance from vehicle to vehicle, because a tailgating vehicle loses road adherence due to turbulences on the vehicle driving in front of it. In addition, an optimization of the tire grip is required for the full output development of the racing cars, for which purpose special tires are used which have an optimum grip only in a narrow region of width of the racing course.

In order to increase the thrill of vehicle races, forced pit stops and refuel stops are provided, which make the individual vehicles move out of the boring successive driving for a short time. More interesting for a spectator, however, is the direct battle of the individual drivers with thrilling overtaking manoeuvres. Thus, there is a need to animate the spectators' interest by thrilling overtaking manoeuvres also in those sections of the racing course in which so far overtaking manoeuvres have been made with difficulties only or not at all.

SUMMARY OF THE INVENTION

For satisfying this need, a device for modifying the layout of a vehicle racing course in a wide section of the track is provided, which is formed of an arrangement consisting of individual elements for defining the edge of the track located in the region of the track section, which can be displaced, either individually or in groups, from an initial configuration, in which the section of the track is unaltered, into a new configuration for reshaping a bend in the racing course or/and for dividing the racing course into separate tracks.

According to the invention, it is an advantage that regions of the racing course may be individually configured such that the vehicles use a layout with different bends or/and separate tracks of the same length or curve progression, where overtaking manoeuvres are possible. Especially if the racing course is divided into separate tracks, the same may be configured on a straight line or with the same sequence of curves or with a mirror-inverted sequence of curves or in a combination of these progressions. After the performance of the new configuration as provided the invention makes a modified layout of a vehicle racing course available, wherein bends in the racing course or/and the division of the racing course preferably into two separate tracks has been achieved, wherein such a modified layout according to the invention may also be maintained permanently after having fixed the defining elements in their configured position. The concept according to the invention thus not only includes the individual configurability of the layout of a vehicle racing course in a wide track section, but also the subsequent fixing of the individual elements for defining the edge of the track after the displacement thereof into a specific position for reshaping a bend in the racing course or/and for dividing the racing course into separate tracks.

Moreover, it is advantageously also possible to make the edge of the track in curves variable by means of variable curbs, i.e. by defining the edges of the track or, respectively, by defining the edge of the curve by raising the edge of the track.

Moreover, it is also possible to compensate advantages or disadvantages of separate tracks by variable curve radii or, respectively, by a variable track width. Variable curve radii, also in combination with different track widths, allow the optimum adaptation of racing courses to different vehicle categories, such as Formula-1 vehicles, racing cars, touring cars, trucks, motorcycles, karts etc. Furthermore, also an adaptation to different weather conditions is advantageously possible by curve shaping and track separation, so as to take atmospheric influences during the race into account. Advantageously, also a modification of the layout with the device according to the invention during a race is possible, e.g. round by round.

According to a preferred embodiment of the invention each individual defining element comprises an adjusting device, preferably including a device for securing the new configuration. This adjusting device preferably comprises a mechanical, electrical or a pressure means actuated drive or a combination thereof, whereby also a manual drive of a mechanical adjusting device may be provided.

For dividing the racing course into two separate tracks defining elements are—according to another embodiment of the invention—also provided at least in the region of the center of the track, which may be activated in the nature of a safety island only at the marginal region of the safety island or over the entire surface thereof, wherein the respective other side of the track may correspondingly be configured with defining elements in the region of the edge of the track. Especially with the defining elements provided in the region of the center of the track it is advantageously provided in accordance with another preferred embodiment that, in the initial configuration, these are aligned with the upper side of the track and that the upper side of the defining elements is preferably provided with a track topping.

The defining elements provided in the region of the edge of the track are, according to another embodiment, formed as a curb part which, according to an embodiment, are mounted in the track so as to be displaceable from their initial configuration into their new configuration. According to another embodiment, the curb parts may be lifted out of their initial configuration immersed in the marginal region and can thus be tilted to form a transitional region between immersed and lifted curb parts.

According to another embodiment of the invention, at least the defining elements in the region of the edge of the track are arranged in a grid-shaped manner and can be lifted, individually or in groups, out of their initial configuration immersed in the marginal region to form a desired curve progression of the edge of the track.

For securing the new configuration of each defining element at least one positively or non-positively engaging holding element is provided, such as a locking device, or the use of a threaded spindle or, for example, a hydraulic holding piston.

For facilitating the modification of the layout it is moreover advantageous, if a preferably central remote control is provided for activating and securing as well as for deactivating the defining elements, whereby also the holding elements provided in accordance with one embodiment may be activated or deactivated by a remote control.

According to another embodiment of the invention each defining element is formed of an upper and a lower portion. This provides for advantages in the fabrication, the maintenance and the adaptation of defining elements to different conditions with respect to the shaping of the edge.

According to another embodiment of the invention curb parts are provided, which have a double T-section in the cross-section. Additionally, or alternatively, also curb parts are provided which have a trapezoidal cross-section.

For achieving the aforementioned object, a method for modifying the layout of a vehicle racing course in a wide track section is moreover provided, wherein individual elements for defining the edge of the track located in the region of the track section are displaced, either individually or in groups, from an initial configuration of the track section into a new configuration for reshaping the bend in the racing course or/and for dividing or newly dividing the racing course.

Thus, according to the method, the layout in the wide track section may be shaped differently according to the bend and the division, wherein the shaping can be maintained as new initial configuration, or also as a final one, not only temporarily, but also over a longer period of time.

Also, modifications in the division of the layouts are possible, wherein the associated outer edges of the respective tracks may be adjusted complementarily in their bending radius. This advantageously results in an extremely high flexibility of the layout, which provides new challenges to the drivers and increases the excitement of the spectators.

Below, the invention will be explained in more detail with reference to the attached drawings.

DETAILED DESCRIPTION OF THE INVENTION

Figure 1:
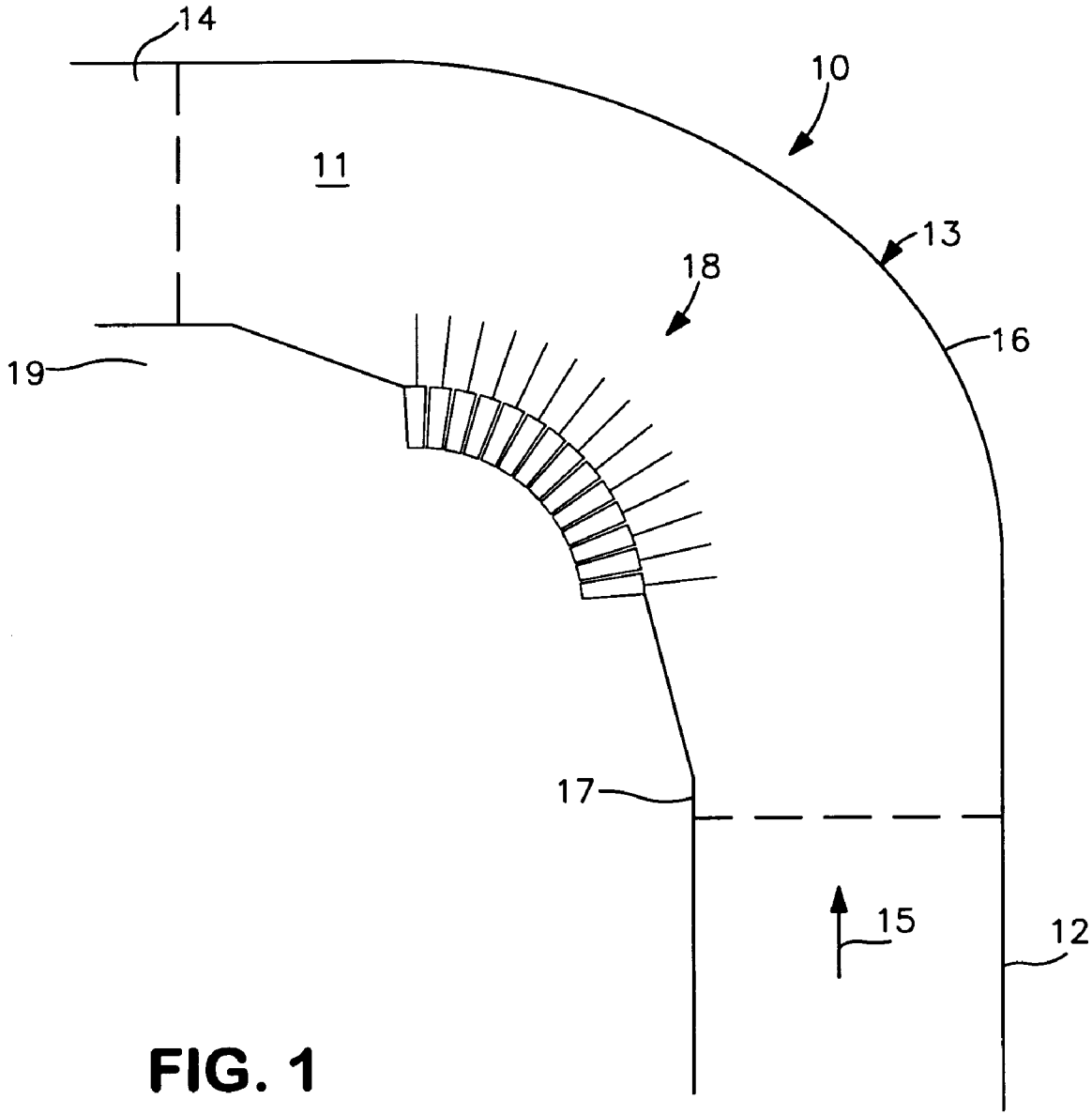
FIG. 1 shows an embodiment of a device according to the invention for reshaping a bend in a racing course in a wide track section in an initial configuration.

FIG. 1 schematically shows a bent wide track section 11 of a vehicle racing course 10. The bent track section 11 extends between a straight section 12 with a section 13 U-bent by 90° to a track section 14. The arrow 15 indicates the driving direction.

Figure 2:
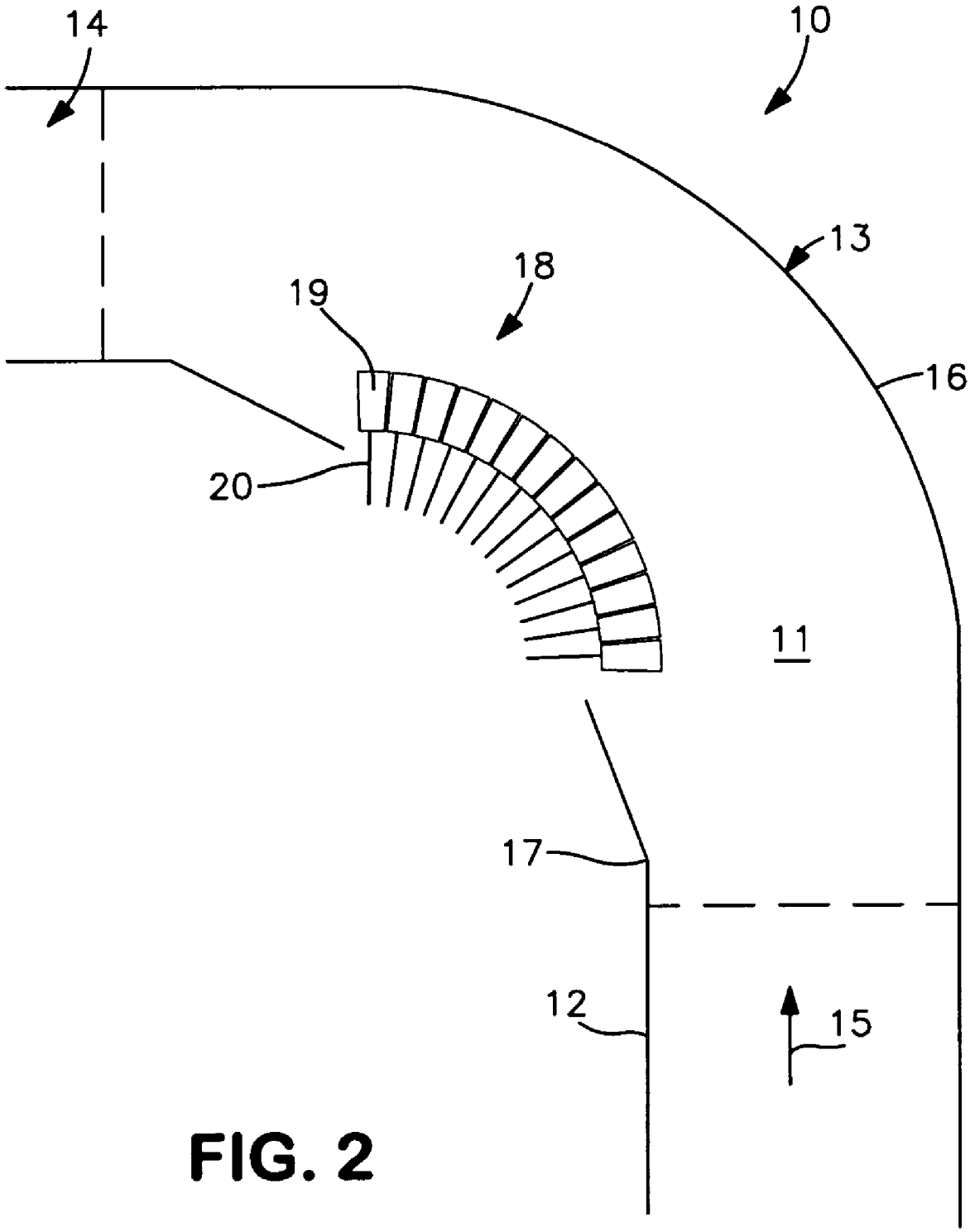
FIG. 2 shows the device according to FIG. 1 in a new configuration for reshaping a bend in a racing course.

The bent section 11 of the track is formed of an outer edge 16 having a large radius and an inner edge 17 having a small radius. An arrangement 18 consisting of individual elements for defining the edge of the track 19 is provided on the inner edge 17, which can be displaced, individually or in groups, from the initial configuration of the track section 13 shown in FIG. 1 into a configuration for reshaping the bend in the racing course according to FIG. 2.

The elements 19 are arranged as curbs element by element and side by side, with gaps being provided between the individual elements. As can be seen in connection with FIGS. 3A and 3B, each curb part 19 is formed, in the section, of a double T-element with an upper part 21 and a lower part 22 connected to each other by a web 23 which is displaceably guided in a slot 20 of the track section 11. The displacement is thereby accomplished in a non-illustrated way, either manually or with a motive or pressure means actuated drive, e.g. by rotating a threaded spindle, by means of a hydraulic piston, by an electric servomotor or the like.

Figure 3B:
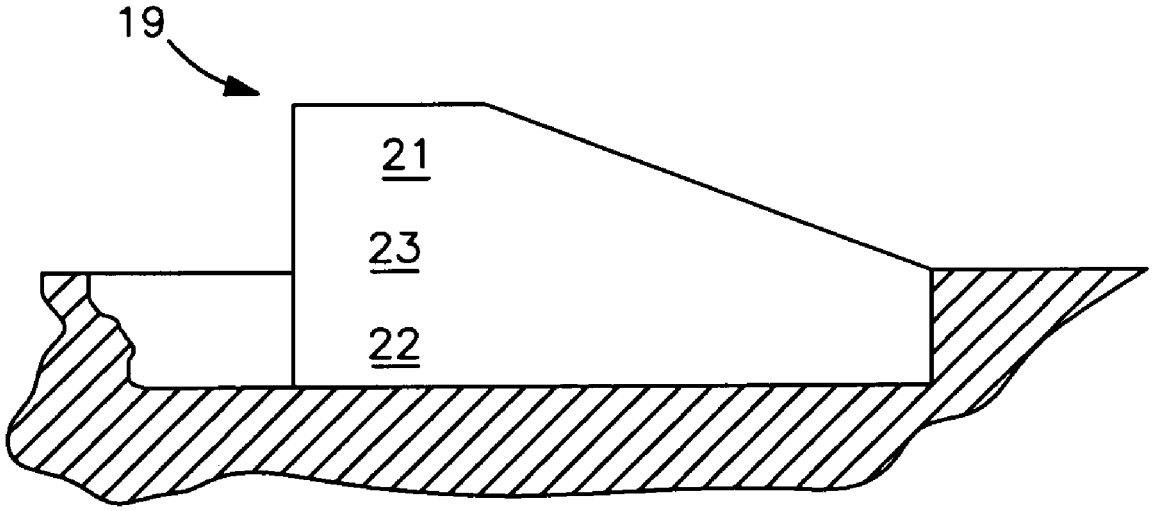
FIG. 3B shows a section along the intersection line IIIB-IIIB in FIG. 3A.
Figure 3A:
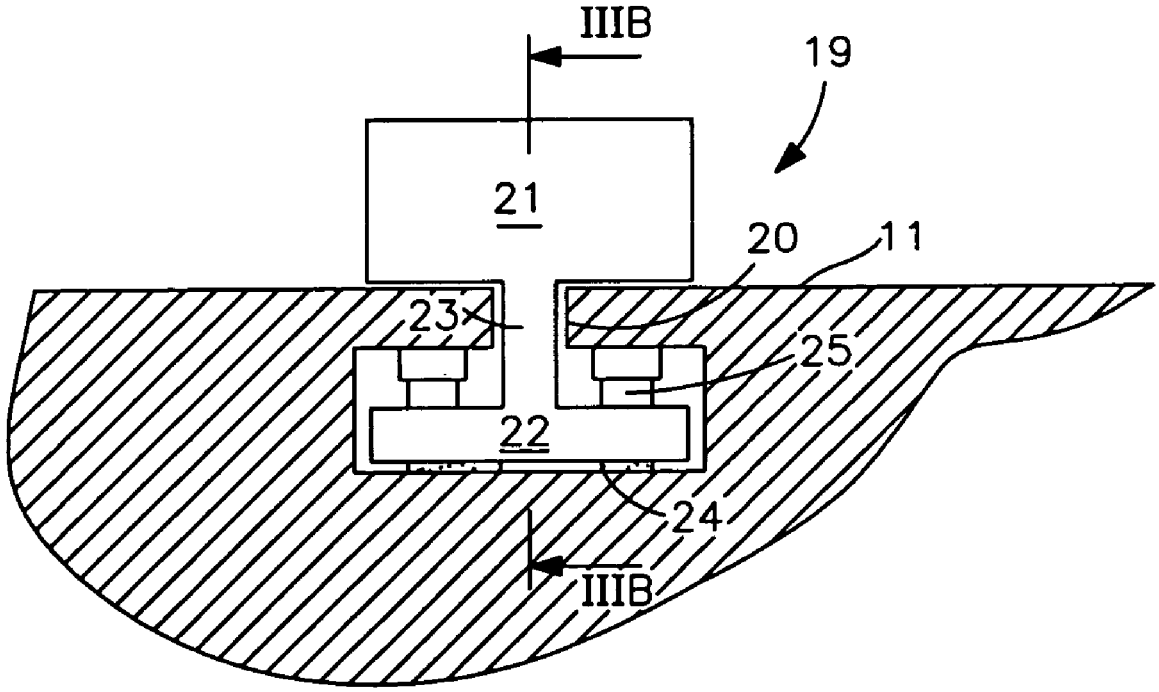
FIG. 3A shows a schematic cross-sectional view of a curb part inserted in the device according to FIG. 1 and FIG. 2.

FIGS. 3A and 3B moreover schematically show that the curb part 19 is arranged with its lower part 22 on a bedding 24. 25 designates a hydraulic pressure cylinder which serves to secure the adjusted new configuration.

In a manner not illustrated, the curb parts 19 may moreover be configured adjustable by means of a mechanical device with respect to their slope to the track. According to FIG. 3B this means a lowering or lifting of the left side of the curb part 19 as to adjust a flatter or steeper curb part. This is advantageous for an adaptation to weather conditions or/and racing cars.

Figure 4:
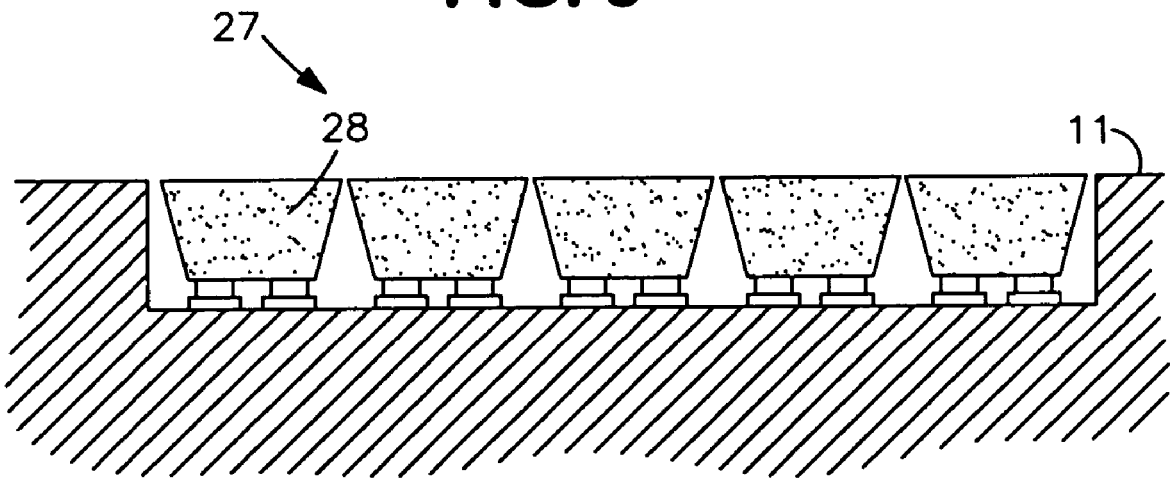
FIG. 4 shows another embodiment of a device with liftable and tiltable curb parts, with all curb parts being immersed in the surface of the track.

FIG. 4 shows a sectional view of another embodiment of an arrangement of elements for defining the edge of a track. With this embodiment, the defining elements of the arrangement 27 consist of curb parts 28 which have a trapezoidal cross-section and which are arranged, individually or in groups, in the marginal region of the track section 11 in alignment with the upper side of the track section 11 according to FIG. 4, and which can individually be lifted out of this position. For forming a transitional region between immersed and lifted body parts 28, one body part—in this case body part 29—is slightly tiltable. The upper sides of the body parts 28 and 29, respectively, are provided with the track topping. The vertical adjusting device and the tilting device have been omitted for the purpose of simplification. In this case, the adjustment is accomplished, for example, with hydraulic adjustment cylinders 30.

Figure 5:
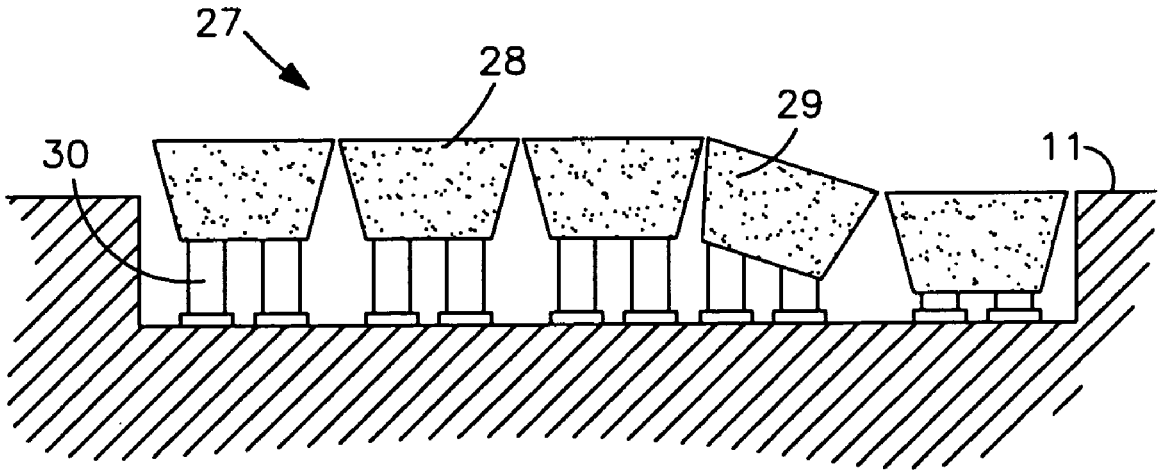
FIG. 5 shows a reconfigured position of the device according to FIG. 7, with three curb parts being fully lifted and with one curb part being arranged to slightly tilt toward a curb part not being lifted.
Figure 6:
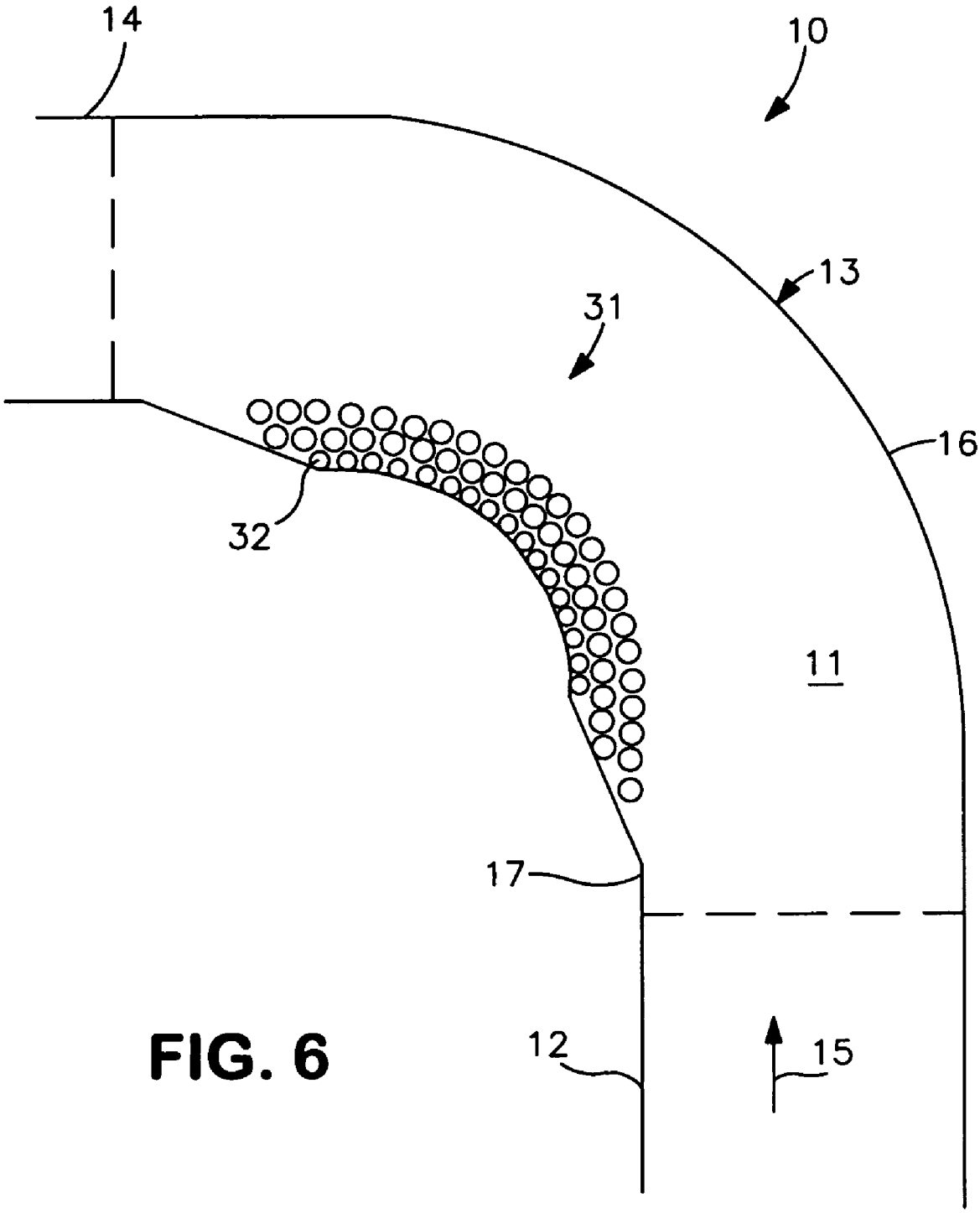
FIG. 6 shows a schematic top view onto another embodiment of a device according to the invention with a grid-shaped arrangement of defining elements in the region of an edge of the track, which may be activated, individually or in groups, to modify a bend in a racing course.

FIG. 6 shows another embodiment of an arrangement 31 consisting of elements for defining the edge of a track 32, which are arranged in a grid-shaped manner and which are formed with extendable cylinders. The curbs 32 may also be formed of groups or rows of individual, upwardly extendable cylinders which, depending on the desired width of the track or, respectively, on the desired radius of the curve, are extended to different heights. Like the curbs 28 and 29 in the embodiment shown in FIG. 4 and FIG. 5, the curbs 30 can be extended wholly or in part between a position in alignment with the track section 11, e.g. by hydraulic pistons or electric servomotors or manually.

In FIG. 6, only a few of the elements for defining the edge of the track 32 are illustrated in the region of the edge of the track section 11. The defining elements 32 may also extend over the entire region of the track section so as to perform, for example, also modifications on the opposite edge.

Figure 7:
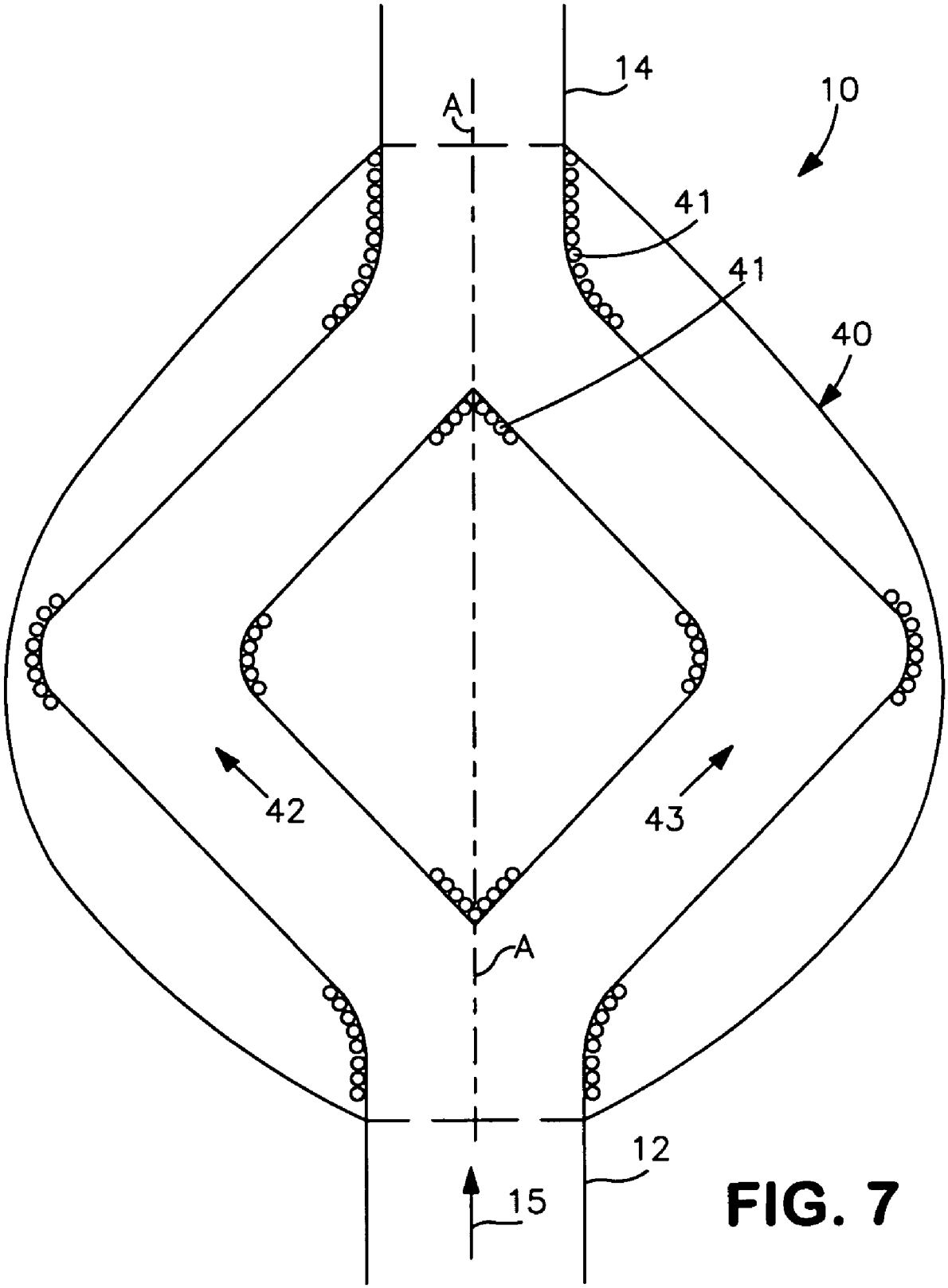
FIG. 7 shows a schematic representation of a racing course divided by the use of the device according to the invention.

FIG. 7 shows another embodiment of a track section 40 which, in a manner not illustrated in the represented embodiment, is nearly completely provided with a grid-shaped arrangement of elements for defining the edge of the track 41 at least in some regions, which are formed similar to the defining elements 32 shown in FIG. 6 and of which only a part is shown in FIG. 7.

Figure 8:
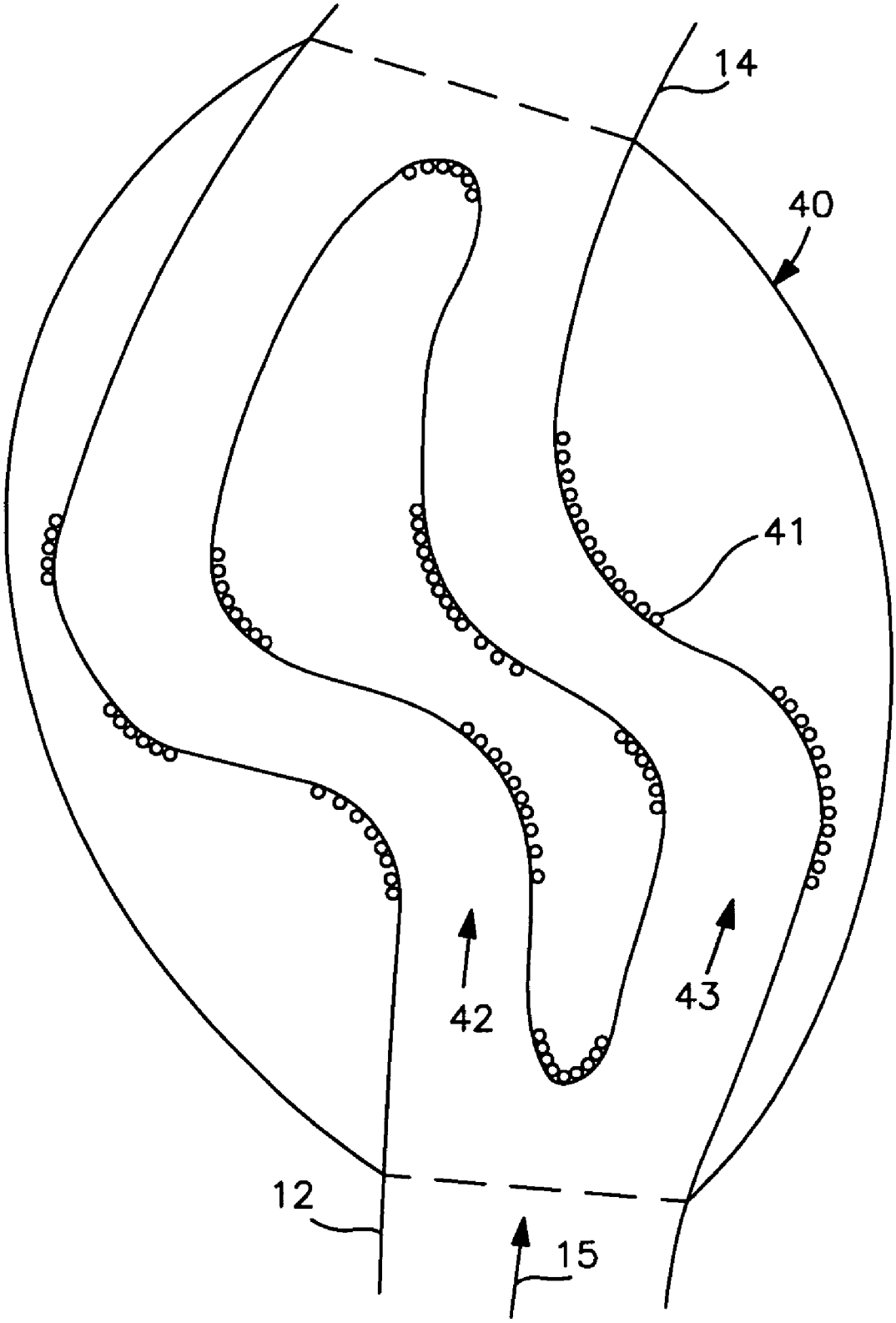
FIG. 8 shows another embodiment of a racing course divided by the use of the device according to the invention.

With respect to the tracks 12 and 14, the track section 40 is considerably enlarged and, due to the conception according to the invention, provides the possibility to perform a division of the racing course into partial sections 42 and 43, each of which are provided with a mirror-symmetrical curve shaping with respect to the longitudinal axis A-A. The radii of the curves may thereby, of course, also be shaped differently in the track section 42 or 43, with another progression as is, for example, shown in FIG. 8. Here, too, the defining elements 41 are only partially shown. In the track section 40, the are provided evenly distributed over the entire track section 40 at least in some regions, which is not illustrated in the represented embodiment.

Although, in the represented embodiments, always only one type of arrangements consisting of individual elements for defining the edge of the track is mentioned, of course, also track sections having different types of defining elements can be realized with the invention. Moreover, the designs of the defining elements are not limited to the represented embodiments, but may also be adapted to the respective individual needs according to shape, arrangement and operation as well as integration into the track section.

What is claimed is:

1. A device for modifying the layout of a vehicle racing course in a wide track section of a track, said track section being arranged substantially within a track plane, said device comprising an arrangement consisting of a plurality of individual curb elements located substantially adjacent to each other in the region of this track section of the racing course, wherein the curb elements can be displaced, either individually or in groups, from an initial configuration along an edge of the track section into a new configuration within the track section for defining a modified edge of the track section for reshaping the racing course in this track section, and wherein the curb elements are double T-elements having a double T-section in the cross section that are oriented transversely with respect to the track section , and wherein the curb elements comprise an upper side which is provided with a track topping, and wherein the curb elements are mounted to be displaceable within the track plane from their initial configuration into a new configuration in the track section.

2. The device according to claim 1, wherein an adjusting device is provided for displacing the curb elements, said adjusting device comprising a mechanical, an electrical or a pressure means actuated drive.

3. The device according to claim 1, wherein each curb element is provided with an adjusting device, preferably comprising a device for securing the new configuration and a mechanical, an electrical or a pressure means actuated drive.

4. A device for modifying the layout of a vehicle racing course in a wide track section of a track comprising an upper side, said device comprising an arrangement consisting of a plurality of individual curb elements located substantially adjacent to each other in a row extending inwardly from an edge of the track section into the region of this track section of the racing course, wherein the curb elements can be displaced, either individually or in groups, from an initial configuration of the track section into a new configuration for reshaping the racing course, wherein the curb elements comprise individually liftable curb elements that are vertically liftable in the region of the track section, the liftable curb elements being aligned flush with the upper side of the track section in their initial configuration and lifted to define a modified edge of the track section in their new configuration, and further curb elements are provided that are tiltable in order to form a transition between lifted and non-lifted curb elements.

5. The device according to claim 4, wherein a preferably central remote control is provided for activating, securing and deactivating the curb elements.

6. The device according to claim 4, wherein a preferably central remote control is provided for activating, securing and deactivating the curb elements.

7. The device according to claim 5, wherein holding elements are provided which can be activated and deactivated by a remote control.

8. The dote according to claim 4, wherein curb elements having an upper and a lower portion are provided.

9. The device according to claim 4, wherein curb elements are provided, which have a trapezoidal cross-section.

10. The device according to claim 4, wherein an adjusting device is provided for displacing the curb elements, said adjusting device comprising a mechanical, an electrical or a pressure means actuated drive.

11. The dote according to claim 4, wherein each curb element s provided with an adjusting device, said adjusting dote comprising a dote for securing the new configuration and a mechanical, an electrical or a pressure means actuated drive.

12. A method for modifying the layout of a vehicle racing course In a wide track section of a track, wherein a plurality of individual curb elements located substantially adjacent to each other in a row extending inwardly from an edge of the track section into the region of the track section are displaced, either individually or in groups, from an initial configuration of the track section into a new configuration for reshaping the racing course in the track section, wherein to reshape the racing course in the track section, several of the curb elements located in the region of the track section are vertically lifted from an initial configuration of the track section in which they are aligned flush with the upper side of the track section into a new configuration in which they are lifted to define a modified edge of the track section, and at least one of the curb elements is tilted in order to form a transition between lifted and non-lifted curb elements.

* * * * *